US010895823B2

(12) United States Patent
Uno et al.

(10) Patent No.: US 10,895,823 B2
(45) Date of Patent: Jan. 19, 2021

(54) DEVELOPING ROLLER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Masashi Uno, Mishima (JP); Ryo Sugiyama, Mishima (JP); Kenta Matsunaga, Susono (JP); Kazuaki Nagaoka, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/870,697

(22) Filed: May 8, 2020

(65) Prior Publication Data

US 2020/0363751 A1 Nov. 19, 2020

(30) Foreign Application Priority Data

May 15, 2019 (JP) ..... 2019-092209

(51) Int. Cl.
*G03G 15/08* (2006.01)

(52) U.S. Cl.
CPC ..... *G03G 15/0808* (2013.01); *G03G 15/0818* (2013.01)

(58) Field of Classification Search
CPC ..... G03G 15/0808; G03G 15/0818; C08F 220/343
See application file for complete search history.

(56) References Cited

U.S. PATENT DOCUMENTS

| | | | |
|---|---|---|---|
| 10,082,741 B2 | 9/2018 | Ishida et al. | |
| 2017/0097580 A1 | 4/2017 | Ishida | |

FOREIGN PATENT DOCUMENTS

| | | | |
|---|---|---|---|
| EP | 3062162 A1 | | 8/2016 |
| JP | H04-027981 A | | 1/1992 |
| JP | H04-50877 A | | 2/1992 |
| JP | 07333965 A | * | 12/1995 |
| JP | 2000098733 A | * | 4/2000 |
| JP | 2006-139206 A | | 6/2006 |
| JP | 2009145473 A | * | 7/2009 |
| JP | 2013-137500 A | | 7/2013 |
| JP | 2017-72831 A | | 4/2017 |
| JP | 2018-25767 A | | 2/2018 |

* cited by examiner

*Primary Examiner* — Susan S Lee
(74) *Attorney, Agent, or Firm* — Canon U.S.A., Inc. IP Division

(57) ABSTRACT

A developing roller that enables the image density of electrophotographic images to be kept uniform even when used in an environment at a high temperature and a high humidity for a long period. The developing roller includes an electro-conductive mandrel and an electro-conductive layer on the mandrel, having an outer surface constituted by at least a first region which is electrically insulating, and a second region, the second region having higher electro-conductivity than that of the first region, the first region being arranged adjacent to the second region, the first region being disposed on an outer surface of the electro-conductive layer, the first region having a Vickers hardness of 10.0 or more as measured at an outer surface thereof, and the first region having a fracture toughness value of 800 $Pa \cdot m^{0.5}$ or more as measured at the outer surface thereof by an indentation fracture method.

7 Claims, 3 Drawing Sheets

DEVELOPING ROLLER, PROCESS CARTRIDGE AND ELECTROPHOTOGRAPHIC IMAGE FORMING APPARATUS

BACKGROUND OF THE INVENTION

Field of the Invention

The present disclosure relates to a developing roller, a process cartridge and an electrophotographic image forming apparatus.

Description of the Related Art

In recent years, with respect to electrophotographic image forming apparatuses (electrophotographic apparatuses), there has been an increased tendency to require downsizing and energy saving, and toner supply rollers to be used for developing apparatuses have tended to have a low torque and a small diameter. However, reduction of the diameter and the torque of a toner supply roller causes the disadvantage that the amount of a toner fed to a developing roller decreases.

As another measure for downsizing electrophotographic apparatuses, there are electrophotographic apparatuses having no toner supply roller. However, electrophotographic apparatuses having no toner supply roller may be unable to output electrophotographic images with an appropriate density because the capacity to supply a toner to a developing roller is insufficient.

Japanese Patent Application Laid-Open No. H04-50877 discloses a developing roller capable of carrying a sufficient amount of a toner. That is, the developing roller has in a vicinity of a surface thereof, many dielectric micro areas and many electro-conductive micro areas which are electrically conducting with an electrically conductive support. In the developing roller of Japanese Patent Application Laid-Open No. H04-50877, a large number of small closed electric fields are formed in the vicinity of a surface of the roller, and due to the closed electric fields, toner is adsorbed to the surface and therefore the developing roller can carry a sufficient amount of a toner on the surface thereof.

Further, Japanese Patent Application Laid-Open No. 2017-72831 discloses an electrophotographic member comprising an electrically insulating domains made of a polymer of an acryloyl group or methacryloyl group-containing compound. Such an electrically insulating domains have an improved abrasion resistance. The present inventors have confirmed that the electro-conductive member of Japanese Patent Application Laid-Open No. 2017-72831 is capable of forming electrophotographic images with a stable density even when the electro-conductive member is used as a developing member to form electrophotographic images over a long period of times.

SUMMARY OF THE INVENTION

One aspect of the present disclosure is directed to providing a developing roller capable of forming high-quality electrophotographic images with stability even when the developing roller is exposed to a severe environment. Another aspect of the present disclosure is directed to providing a process cartridge which contributes to stable formation of high-quality electrophotographic images. Further, still another aspect of the present disclosure is directed to providing an electrophotographic image forming apparatus capable of forming high-quality electrophotographic images with stability. According to one aspect of the present disclosure, there is provided a developing roller comprising: an electro-conductive mandrel; and an electro-conductive layer on the mandrel, the developing roller having an outer surface constituted by at least a first region which is electrically insulating, and a second region, the second region having higher electro-conductivity than that of the first region, the first region being arranged adjacent to the second region, the first region being disposed on an outer surface of the electro-conductive layer, the first region having a Vickers hardness of 10.0 or more as measured at an outer surface thereof, and the first region having a fracture toughness value of 800 $Pa \cdot m^{0.5}$ or more as measured at the outer surface thereof by an indentation fracture method. According to another aspect of the present disclosure, there is provided a process cartridge detachably attachable on a main body of an electrophotographic image forming apparatus, the process cartridge including at least a developing unit, the developing unit including the developing roller. According to still another aspect of the present disclosure, there is provided an electrophotographic image forming apparatus including a developing unit, the developing unit including the developing roller.

Further features of the present disclosure will become apparent from the following description of exemplary embodiments with reference to the attached drawings.

DESCRIPTION OF THE EMBODIMENTS

Figure 1A:
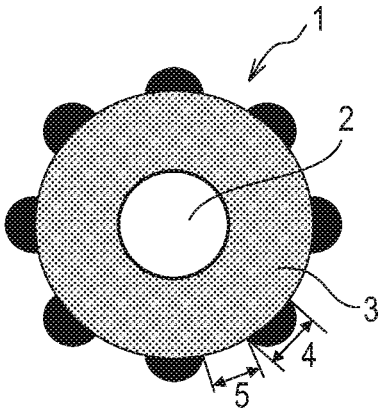
FIG. 1A is a schematic sectional view illustrating one embodiment of a developing roller of the present disclosure.

Preferred embodiments of the present disclosure will now be described in detail in accordance with the accompanying drawings.

It was confirmed that the electrophotographic member of Japanese Patent Application Laid-Open No. 2017-72831 was capable of forming electrophotographic images with a uniform image density even when the electrophotographic member was used as a developing member for formation of electrophotographic images over a long period of time in a low-temperature and low-humidity environment at a temperature of 15° C. and a relative humidity of 10% (hereinafter, also referred to as 10% RH) after being left standing in this environment for 24 hours. Then, the present inventors examined the durability of the developing roller of Japanese Patent Application Laid-Open No. 2017-72831 under more severe conditions. Specifically, the developing roller was subjected to a heat cycle test as described below. The result showed that there were cases where the density of electrophotographic images was reduced when the developing roller after the heat cycle test was used for formation of electrophotographic images.

Heat Cycle Test

A new developing roller is left standing in a high-temperature and high-humidity environment at a temperature of 40° C. and 95% RH for 12 hours. Subsequently, the developing roller is transferred into a low-temperature and low-humidity environment at a temperature of 15° C. and 10% RH, and left standing for 12 hours. The process in which the developing roller is left standing in a high-temperature and high-humidity environment for 12 hours and then in a low-temperature and low-humidity environment for 12 hours is set as one cycle, and the cycle is repeated five times.

Reduction of the density of electrophotographic images at the time of subjecting the developing roller of Japanese Patent Application Laid-Open No. 2017-72831 to the heat cycle test is ascribable to generation of fine cracks on the domains as a result of subjecting the developing roller to the heat cycle test. That is, the developing roller of Japanese Patent Application Laid-Open No. 2017-72831 has good abrasion resistance, but depending on a selected constituent material of the domains, the domains become brittle, so that fine cracks are gradually generated on the domains due to contact with a toner regulating member and a photosensitive drum. Since the domains having cracks have increased surface areas, moisture is more easily adsorbed to the domains. Since the domains with moisture adsorbed thereto have increased electro-conductivity, the amount of charge accumulable by the domains decreases. The magnitude of a coulomb force or a gradient force for attracting a toner to the domains is proportional to the amount of charge that is accumulated by the domains. Thus, the domains with moisture adsorbed thereto may have a reduced coulomb force or gradient force for attracting a toner, leading to a decrease in the amount of a toner conveyable by the insulating domains.

The present inventors have extensively conducted studies, and resultantly found that a developing roller having an electrically insulating region, i.e. a first region, with specific physical properties can accumulate electric charge stably at the first region even after the developing roller is subjected to a heat cycle test.

That is, the developing roller according to one aspect of the present disclosure is a developing roller including an electro-conductive mandrel, and an electro-conductive layer on the mandrel, and having an outer surface constituted by at least a first region which is electrically insulating, and a second region having a higher electro-conductivity than that of the first region. Here, an outer surface of the developing roller is a surface on which toner is held. The first region is arranged adjacent to the second region, and the first region is disposed on a surface of the electro-conductive layer. Further, the first region has a Vickers hardness of 10.0 or more as measured at an outer surface thereof, and the first region has a fracture toughness value of 800 $Pa \cdot m^{0.5}$ or more as measured at the outer surface thereof by an indentation fracture method.

<Developing Roller>

Figure 1B:
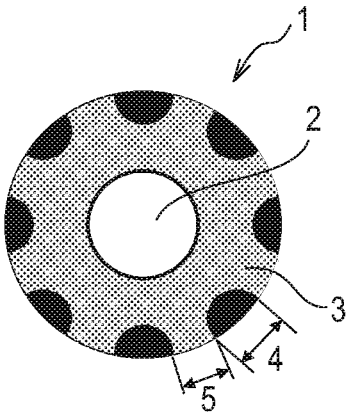
FIG. 1B is a schematic sectional view illustrating another embodiment of the developing roller of the present disclosure.

FIG. 1A is a schematic sectional view of a developing roller according to one aspect of the present disclosure, which is cut in a direction orthogonally crossing a longitudinal direction (axial direction). The developing roller 1 shown in FIG. 1A includes an electro-conductive mandrel 2, an electro-conductive layer 3 on the mandrel, and a first region 4 having electrical insulation property on the outer surface of the electro-conductive layer (surface on a side opposite to a surface facing the mandrel), and the region 4 has a projected portion formed on the outer surface of the developing roller 1. A portion of the electro-conductive layer, which is exposed to the outer surface of the developing roller 1, is a second region 5. That is, the second region 5 is a portion of a surface of the electro-conductive layer on a side opposite to a side facing the mandrel 2 (hereinafter, the surface is also referred to as an "outer surface"), where the portion is not covered with the first region. The second region 5 has electro-conductivity higher than that of the first region 4. FIG. 1B is a schematic sectional view of a developing roller according to another aspect of the present disclosure, which is cut in a direction orthogonally crossing a longitudinal direction. In the developing roller shown in FIG. 1B, the first region 4 having electrical insulation property is present in the electro-conductive layer 3, and the first region 4 and the second region 5 are exposed to the outer surface of the developing roller. In this aspect, the first region 4 does not have a projected portion formed on the outer surface of the developing roller.

Presence of the first region 4 having electrical insulation property and the second region 5 having electro-conductivity higher than that of the first region 4 can be confirmed by charging the outer surface of the developing roller 1, and then measuring a residual potential distribution thereof. The residual potential distribution can be confirmed by, for example, sufficiently charging the outer surface of the developing roller with a charge apparatus such as a corona discharge apparatus, and then measuring the residual potential distribution of the charged outer surface of the developing roller with an electrostatic force microscope (EFM), a Kelvin force microscope (KFM) or the like.

<Mandrel>

The mandrel has electro-conductivity, and serves to support the electro-conductive layer provided thereon. Examples of materials for the mandrel include metals such as iron, copper, aluminum and nickel; and alloys including any of these metals, such as stainless steel, duralumin, brass and bronze. These materials may be used singly, or in combination of two or more thereof. For the purpose of imparting scratch resistance, the surface of the mandrel may be subjected to plating treatment to the extent that electro-conductivity is not impaired. It is also possible to use a mandrel in which the surface of a resin mandrel is covered with a metal to make the surface electro-conductive; or a mandrel produced from an electro-conductive resin composition.

<Electro-Conductive Layer>

The electro-conductive layer is disposed on the mandrel, and may have a single-layer structure or a layered structure having two or more layers. A developing roller having two or more electro-conductive layers is suitably used particularly in a nonmagnetic one-component contact development system process. When the developing roller has a plurality of electro-conductive layers, it is preferable to satisfy the following regarding each electro-conductive layer unless otherwise specified.

The electro-conductive layer may contain an elastic material such as a resin or a rubber. Specific examples of the resin or rubber include polyurethane resins, polyamide, urea resins, polyimide, melamine resins, fluororesins, phenol resins, alkyd resins, silicone resins, polyester, ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, hydrogenated NBR, and urethane rubber. These resins or rubbers may be used singly or in combination of two or more thereof as required.

The material for the resin or rubber can be identified by measuring the electro-conductive layer of the developing roller with a Fourier transform infrared spectrophotometer.

When the electro-conductive layer has a layered structure, it is preferable that the layer (lower layer) of the electro-conductive layer, which is disposed on a side closest to the mandrel side, contain a silicone rubber among the above-described materials. Examples of the silicone rubber include polydimethylsiloxane, polymethyltrifluoropropylsiloxane, polymethylvinylsiloxane, polyphenylvinylsiloxane and copolymers of these siloxanes.

It is preferable that the layer (outermost layer) of the electro-conductive layer, which is disposed on a side closest to the outer surface, contain a polyurethane resin. The polyurethane resin is preferable because the polyurethane resin is excellent in frictional charging performance with respect to a toner, is excellent in flexibility and thus likely to contact the toner, and has abrasion resistance. Examples of the polyurethane resin include ether-based polyurethane resins, ester-based polyurethane resins, acryl-based polyurethane resins and carbonate-based polyurethane resins. These polyurethane resins can be obtained by reacting a known polyol with an isocyanate compound.

Specific examples of the polyol include polyether polyols such as polyethylene glycol, polypropylene glycol and polytetramethylene glycol; polyester polyols such as polyethylene succinate diol, polybutylene succinate diol, polyethylene adipate diol and polybutylene adipate diol; and polycarbonate polyols such as polyethylene carbonate diol and polybutylene carbonate diol.

Examples of the isocyanate component which is reacted with these polyol components include, but are not limited to, aliphatic polyisocyanates such as ethylene diisocyanate and 1,6-hexamethylene diisocyanate (HDI); cycloaliphatic polyisocyanates such as isophorone diisocyanate (IPDI), cyclohexane-1,3-diisocyanate and cyclohexane-1,4-diisocyanate; aromatic isocyanates such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate and naphthalene diisocyanate; copolymers, isocyanurates, TMP adducts and biurets thereof; and blocks thereof. Among them, aromatic isocyanates such as tolylene diisocyanate, diphenylmethane diisocyanate and polymeric diphenylmethane diisocyanate are more suitably used.

It is preferable that the electro-conductive layer contain an electro-conductive agent. Examples of the electro-conductive agent include ionic electro-conductive agents and electronic electro-conductive agents such as carbon black, and carbon black is preferable because the electro-conductivity of the electro-conductive layer and the charging performance of the electro-conductive layer with respect to a toner can be controlled. It is preferable that the volume resistivity of the electro-conductive layer be normally within the range of $1.0\times10^{3}$ Ω·cm or more and $1.0\times10^{11}$ Ω·cm or less. The volume resistivity of the electro-conductive layer can be measured by using the same method as that for the volume resistivity of the first region described later.

Specific examples of the carbon black include electro-conductive carbon black such as "Ketjen Black" (trade name) (manufactured by Lion Corporation) and acetylene black; and carbon black for rubber such as SAF, ISAF, HAF, FEF, GPF, SRF, FT and MT. As other carbon black, oxidized carbon black for color ink or thermally decomposed carbon black may be used.

The amount of carbon black added is preferably 5 parts by mass or more and 50 parts by mass or less based on 100 parts by mass of the total of the resin and rubber in the electro-conductive layer. The content of carbon black in the electro-conductive layer can be measured with a thermogravimetric analyzer (TGA).

Examples of electro-conductive agents usable for the electro-conductive layer, other than the above-described carbon black, include graphite such as natural graphite and artificial graphite; powders of metals such as copper, nickel, iron, aluminum and the like; powders of metal oxides such as titanium oxide, zinc oxide and tin oxide; and electro-conductive polymers such as polyaniline, polypyrrole and polyacetylene. These electro-conductive agents may be used singly or in combination of two or more thereof as appropriate. The amounts of these electro-conductive agents added may be appropriately set.

The electro-conductive layer may additionally contain a charge controlling agent, a lubricant, a filler, an antioxidant, an anti-aging agent and the like to the extent that the functions of the resin and rubber and the electro-conductive agent are not hindered. The amounts of these additives added may be appropriately set.

The thickness of the electro-conductive layer (total thickness in the case of a layered structure) is preferably 1 μm or more and 5 mm or less. The thickness of the electro-conductive layer can be determined by cutting the electro-conductive layer in a direction perpendicular to the axial direction of the developing roller, observing the resulting cut section with an optical microscope, and performing measurement.

When the developing roller is required to have surface roughness, a particle for roughness control may be incorporated into the electro-conductive layer. Here, the volume average particle size of the particle for roughness control is preferably 3 μm or more and 20 μm or less. The amount of the particle contained in the electro-conductive layer is preferably 1 part by mass or more and 50 parts by mass or less based on 100 parts by mass of the total of the resin and rubber in the electro-conductive layer. The content of the particle in the electro-conductive layer can be measured by using an analysis method such as, for example, thermogravimetric analysis.

As the particle for roughness control, a fine particle of polyurethane resin, polyester resin, polyether resin, polyamide resin, acrylic resin, polycarbonate resin or the like may be used.

<First Region>

A first region which is electrically insulating (which has electrical insulation property) is present as a part of a surface (outer surface) of the developing roller. The first region is disposed on the outer surface of the electro-conductive layer (electro-conductive layer which is the outermost surface in the case where the developing roller has a plurality of electro-conductive layers), and serves as an electrical insulating section (hereinafter, sometimes referred to as an insulating section). The first region is disposed adjacent to a second region as described later. The first region may be present (exposed) on a part of the outer surface of the developing roller, and a plurality of insulating sections may be separately on the outer surface of the developing roller, or a plurality of insulating sections may be present in a state of being connected together (for example, as a series of insulating sections). However, it is preferable that a plurality of first regions (for example with a dot shape) be disposed at equal intervals on the outer surface of the electro-conductive layer from the viewpoint of uniformly conveying a toner. The proportion of the area of the first region in the outer surface area of the developing roller is preferably 10% or more and 60% or less from the viewpoint of imparting an appropriate gradient force to the developing roller. The proportion of the area of the first region can be measured with, for example, a video microscope (trade name: DIGITAL MICROSCOPE VHX-500) (manufactured by KEYENCE CORPORATION). The volume resistivity of the first region is preferably $1.0\times10^{13}$ Ω·cm or more and $1.0\times10^{18}$ Ω·cm or less. When the volume resistivity is within the above-mentioned range, the first region can be easily charged. The volume resistivity of the first region can be measured by a method as described later.

[Vickers Hardness and Fracture Toughness Value of First Region]

The first region has a Vickers hardness of 10.0 or more and a fracture toughness value of 800 $Pa\cdot m^{0.5}$ or more as measured at the outer surface thereof, i.e. an outer surface portion of the first region which is present on the outer surface of the developing roller. When the Vickers hardness is 10.0 or more, the insulating section has sufficient abrasion resistance, and therefore a decrease in volume of the insulating section due to abrasion can be suppressed even when the developing roller is used over a long period of time. When the fracture toughness value measured at the outer surface of the insulating section by an indentation fracture method is 800 $Pa\cdot m^{0.5}$ or more, the insulating section has sufficient crack resistance, and therefore generation of fine cracks can be suppressed even when the developing roller is used over a long period of time. Thus, by ensuring that the insulating section has sufficient abrasion resistance and crack resistance, charge can be accumulated with stability even when the developing roller is used in an environment at a high temperature and high humidity over a long period of time. The Vickers hardness is preferably 15.0 or more, more preferably 20.0 or more. The fracture toughness value is preferably 1000 $Pa\cdot m^{0.5}$ or more, more preferably 1200 $Pa\cdot m^{0.5}$ or more.

The Vickers hardness and the fracture toughness value of the first region serving as an electrical insulating section can be measured as follows based on the measurement procedure of the IF method described in the Japanese Industrial Standard (JIS) R1607: 2015 (Testing methods for fracture toughness of fine ceramics at room temperature). Specifically, a microhardness tester (trade name: FISCHERSCOPE PICODENTOR HM500) (manufactured by Fischer Instruments K.K.) is used as a measurement apparatus, and a Vickers indenter is used as a measurement indenter. The developing roller is horizontally placed, and the outer surface of the developing roller, which is covered with the electrical insulating section, is observed with a microscope. Subsequently, the position is adjusted so that the indenter contacts the electrical insulating section at any position, and the indenter is made to contact the electrical insulating section with a test load of 0.1 mN and a test load holding time of 15 seconds. Thereafter, the contact surface of the electrical insulating section is observed with an optical microscope, the lengths of two diagonal lines of the indenter trace are measured, and an average of the lengths is calculated. The lengths of cracks extending along the extended lines of two diagonal lines of the indenter trace are measured, and an average of the lengths is calculated. From the obtained average of the lengths of the diagonal lines of the indenter trace, and the test load, the Vickers hardness is calculated based on the following expression.

$$\text{Vickers hardness}=0.1891\times F/d^2$$

F: Test load [N];

d: Average of lengths of diagonal lines of indenter trace [mm].

From the obtained average of the lengths of the diagonal lines of the indenter trace, and the test load, the fracture toughness value is calculated from the following expression.

$$\text{Fracture toughness value } [Pa\cdot m^{0.5}]=0.026\times E^{0.5}\times F^{0.5}\times a/C^{1.5}$$

E: elastic modulus of electrical insulating section [Pa]

F: Test load [N];

a: Average of lengths of diagonal lines of indenter trace [m];

C: Average of lengths of cracks [m].

[Material Forming First Region]

The material forming the first region is preferably a resin. Examples of the resin include acrylic resins, polyolefin resins, epoxy resins and polyester resins. Among them, acrylic resins having a structure of the following structural formula (1) are preferable because the Vickers hardness and the fracture toughness value of the first region are easily adjusted within the above-described ranges. The chemical structure of a material forming the first region can be identified by solid $^1$H-NMR analysis.

$[A]_n$-R Structural formula (1)

wherein A represents a structure of the following structural formula (2), n represents an integer of 2 or more, and R represents a linking group linking n As.

Structural Formula (2)

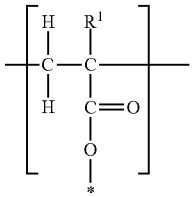

wherein $R^1$ represents a hydrogen atom or a methyl group, and the symbol * represents a binding site with the linking group R.

Specific examples of the acrylic resin include polymers obtained by polymerizing any of various (meth)acrylate compounds (at least one of a methacrylate compound and an acrylate compound) by a method such as photopolymerization. The structure of the linking group R in the structural formula (1) is determined by the structure of a (meth) acrylate compound to be polymerized or a crosslinking agent to be used. It is preferable that the (meth)acrylate compound forming the acrylic resin have a plurality of (meth)acryloyl groups per molecule for developing high abrasion resistance and crack resistance. n in the structural formula (1) may be an integer of 2 or more, and may be appropriately set, and in particular, n is preferably 3 or more and 9 or less for achieving both abrasion resistance and crack resistance. Specific examples of the (meth)acrylate compound used for the acrylic resin of the above structural formula (1) include polyether (meth)acrylate, polyester (meth)acrylate, epoxy (meth)acrylate, urethane (meth)acrylate and mixtures thereof. Among these (meth)acrylate compounds, polymers containing a urethane (meth)acrylate compound have a structure in which the linking group R has a urethane bond, and the polymers enable achievement of both abrasion resistance and crack resistance at a high level.

The reason why the polymer containing a urethane (meth) acrylate compound enables achievement of both abrasion resistance and crack resistance at a high level may be as follows. That is, the polymer containing a urethane (meth) acrylate compound has a urethane backbone derived from the original urethane (meth)acrylate compound, and a hydrocarbon backbone generated by polymerization of (meth)acryloyl groups. The hydrocarbon backbone generated by polymerization of (meth)acryloyl groups has a rigid cross-linked structure, and is hardly subject to cleavage of a molecular chain. Thus, the polymer may be able to attain a property of abrasion resistance. The urethane backbone has hydrogen bonds between urethane bonds in the backbone, and the hydrogen bonds can repeatedly undergo cleavage and recombination in response to deformation of the polymer. It is considered that owing to this property, the polymer develops flexibility, and therefore cracks are hardly generated even when the polymer is subjected to external force.

Among polymers containing a urethane (meth)acrylate compound, those in which the linking group R has a structure of the following structural formula (3) are more preferable from the viewpoint of crack resistance. In other words, polymers containing a urethane (meth)acrylate compound of the structural formula (3), which has an alkylene group having 6 or more carbon atoms (the alkylene group optionally has a cyclic structure), between adjacent urethane bonds are more preferable because the polymers have excellent crack resistance.

Structural Formula (3)

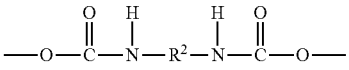

wherein $R^2$ is an alkylene group having 6 or more carbon atoms, and the alkylene group optionally has a cyclic structure.

According to the present inventors, the reason why polymers containing a difunctional or more-functional urethane (meth)acrylate compound having the above-mentioned structure have excellent crack resistance may be as follows. That is, when there is a distance of 6 or more carbon atoms between urethane bonds, the urethane backbone has a relatively wide range of movement. When the molecular chain between urethane bonds is an alkylene group, the polymer does not have a rigid structure like an aromatic ring, and therefore the urethane backbone has a flexible structure. Thus, when the urethane backbone has a relatively wide range of movement and a flexible molecular chain, the molecular chain of the urethane backbone freely moves in the resin structure. Thus, when the polymer is subjected to external force and thereby deformed, hydrogen bonds may more easily undergo cleavage and recombination in response to the deformation. Polymers containing a urethane (meth)acrylate compound, which has an alkylene group having 6 or more carbon atoms, between adjacent urethane bonds, may develop further excellent crack resistance.

Polymers containing a urethane (meth)acrylate compound in which $R^2$ in the structural formula (3) has a structure of the structural formula (4) have particularly excellent crack resistance.

Structural formula (4)

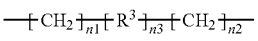

In the structural formula (4), n1 and n2 are each independently an integer of 0 or more, n3 is 0 or 1, n1+n2 is 6 or more and 10 or less when n3 is 0, n1+n2 is 0 or more and 4 or less when n3 is 1, and $R^3$ is a cyclic alkylene group optionally having a substituent.

According to the present inventors, the reason why polymers containing a urethane (meth)acrylate compound having the above-mentioned structure have particularly excellent crack resistance may be as follows. As described above, when there is a distance of 6 or more carbon atoms between urethane bonds, the urethane backbone has a relatively wide range of movement, and this may be a factor of developing excellent crack resistance. However, when there is a significant distance between urethane bonds, excellent crack resistance may be hardly developed because the density of hydrogen bonds in the urethane backbone decreases. Thus, for developing particularly excellent crack resistance, it is necessary that the distance between urethane bonds be made to fall within an appropriate range. When $R^2$ in the structural formula (3) is a linear alkylene group containing no cyclic structure, e.g. when n3 in the structural formula (4) is 0, the distance between urethane bonds can be easily made to fall within an appropriate range by setting the number of carbon atoms of $R^2$ to 6 to 10, e.g. by setting the n1+n2 in the structural formula (4) to 6 to 10. On the other hand, $R^2$ is an alkylene group containing a cyclic structure, i.e. n3 in the structural formula (4) is 1, the distance between urethane bonds can be easily made to fall within an appropriate range by setting the number of carbon atoms of the linear structure moiety of $R^2$ to 0 to 4, i.e. by setting the n1+n2 in the structural formula (4) to 0 to 4. Examples of the cyclic alkylene group represented by $R^3$ in the structural formula (4) include a cyclohexylene group, a cycloheptylene group and a cyclooctylene group. Examples of the substituent which is optionally present in the cyclic alkylene group include a methyl group, an ethyl group and a propyl group. The cyclic alkylene group may have one or more of these substituents. The number of carbon atoms of $R^1$ in the structural formula (3) includes the number of carbon atoms of the substituent. The structure of $R^1$ is derived from a raw material isocyanate compound for forming a urethane bond. Examples of the raw material isocyanate compound include cycloaliphatic diisocyanates such as isophorone diisocyanate and dicyclohexylmethane diisocyanate, and aliphatic linear diisocyanates such as hexamethylene diisocyanate.

<Second Region>

A second region which is adjacent to the first region and serves as an electro-conductive section having electro-conductivity higher than that of the first region is present on a part of the outer surface of the developing roller. In the aspect shown in FIGS. 1A and 1B, a part of the electro-conductive layer forming the outer surface of the developing roller corresponds to the second region. The second region may be present (exposed) on a part of the outer surface of the developing roller, and a plurality of electro-conductive sections may be separately on the outer surface of the developing roller, or a plurality of electro-conductive sections may be present in a state of being connected together (for example, as a series of electro-conductive sections). However, it is preferable that (a series of) second regions be disposed so as to surround a plurality of first regions (for example with a dot shape) disposed at equal intervals on the outer surface of the developing roller from the viewpoint of uniformly conveying a toner. The proportion of the area of the second region in the outer surface area of the developing roller is preferably 40% or more and 90% or less from the viewpoint of imparting an appropriate gradient force to the developing roller. The proportion of the area of the second region can be measured with, for example, a video microscope (trade name: DIGITAL MICROSCOPE VHX-500) (manufactured by KEYENCE CORPORATION).

<Method for Forming First Region and Second Region>

Examples of methods for forming an electrical insulating section as the first region and an electro-conductive section as the second region having electro-conductivity higher than that of the first region in the developing roller include the following methods i) and ii):

method i): a method in which a mixture of an electrical insulating material and an electro-conductive material is applied to an electro-conductive layer by dipping, and subjected to phase separation; a method in which an electrical insulating particle is blended beforehand in a material for forming an electro-conductive layer, and after formation of the electro-conductive layer, the surface of the electro-conductive layer is polished to expose the electrical insulating particle; and method ii): a method in which an electro-conductive layer is pattern-printed with an electrical insulating material by an inkjet method. Of these methods, the method ii) is preferable because the electrical insulating section can be easily pattern-printed in a desired shape.

The developing roller of this aspect may be applied to any of a non-contact developing apparatus and a contact developing apparatus using a magnetic one-component developer or a nonmagnetic one-component developer, and a developing apparatus using a two-component developer.

<Process Cartridge>

Figure 2:
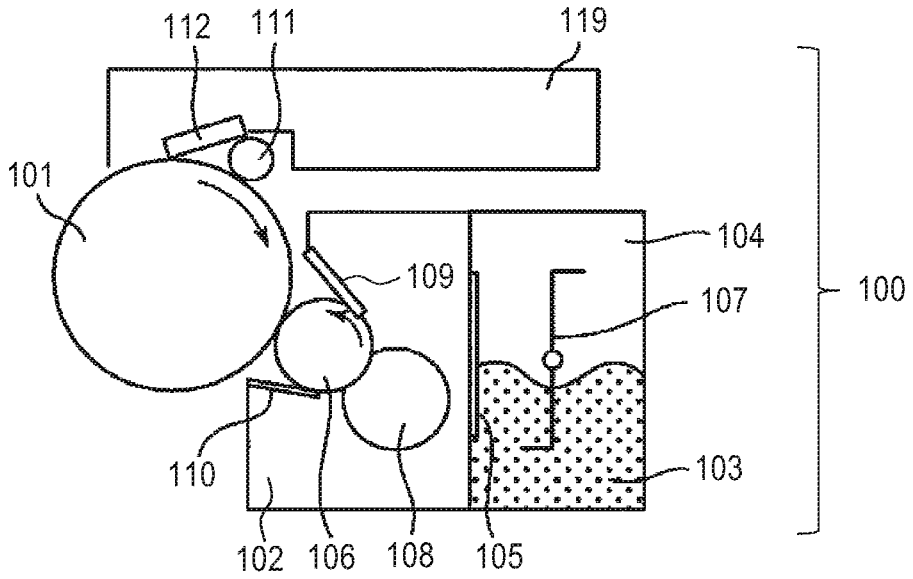
FIG. 2 is a schematic block diagram of an example of a process cartridge according to one aspect of the present disclosure.

The process cartridge according to this aspect includes at least a developing unit, the developing unit having the developing roller according to this aspect. FIG. 2 is a schematic sectional view of an example of the process cartridge according to one aspect of the present disclosure.

The process cartridge 100 shown in FIG. 2 is detachably attached on a main body of an electrophotographic apparatus. The process cartridge 100 includes a developing chamber 102 having an opening in a portion opposed to an electrophotographic photosensitive member 101, and a toner container 104 for storing a toner 103 is disposed on the back surface of the developing chamber 102. If necessary, a conveyance member 107 for conveying a toner 103 into the developing chamber 102 is disposed in the toner container 104. The opening allowing the developing chamber 102 to communicate with the toner container 104 is partitioned by a seal member 105, and the seal member 105 is removed at the time of starting use of the process cartridge 100. The developing chamber 102 is provided with a developing roller 106, a toner supply roller 108, a developing blade 109 and a toner blowoff preventing sheet 110.

The toner 103 is applied to the developing roller 106 by the toner supply roller 108. The developing roller 106 is rotated in a direction indicated by the arrow in the figure, and the toner 103 carried on the developing roller 106 is regulated to a predetermined layer thickness by the developing blade 109, and then sent to a developing region opposed to the electrophotographic photosensitive member 101.

The process cartridge 100 includes a charging roller 111, a cleaning blade 112 and a waste toner container 119 in addition to the above configuration.

<Electrophotographic Image Forming Apparatus>

Figure 3:
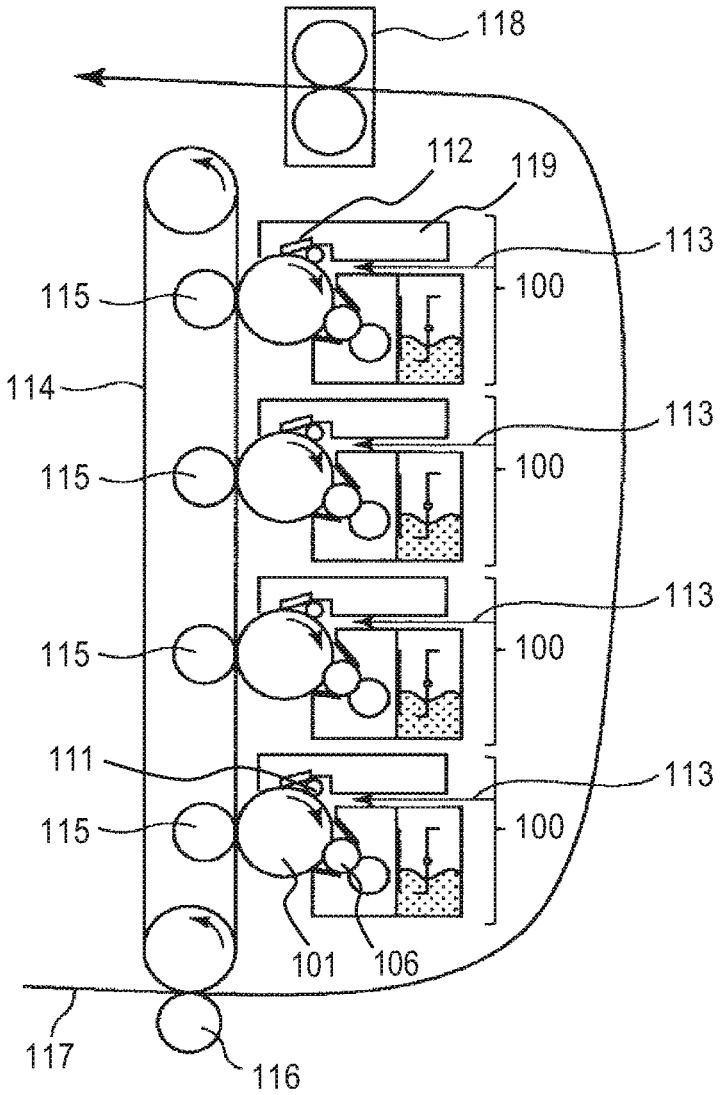
FIG. 3 is a schematic block diagram of an example of an electrophotographic apparatus according to one aspect of the present disclosure.

The electrophotographic image forming apparatus (electrophotographic apparatus) according to this aspect includes a developing unit, the developing unit having the developing roller according to this aspect. FIG. 3 is a schematic sectional view of an example of the electrophotographic apparatus according to one aspect of the present disclosure. The process cartridge 100 shown in FIG. 2 may be attached to the electrophotographic apparatus.

The print operation of the electrophotographic apparatus will be described below. The electrophotographic photosensitive member 101 is uniformly charged by the charging roller 111 connected to a power supply for bias (not shown). Next, an electrostatic latent image is formed on the surface of the electrophotographic photosensitive member 101 by exposing light 113 for writing an electrostatic latent image. As the exposing light 113, either LED light or laser light may be used.

Next, a negatively charged toner is added to the electrostatic latent image (developed) by the developing roller 106 contained in the process cartridge 100 detachably attached to the electrophotographic apparatus main body. Next, a toner image is formed on the electrophotographic photosensitive member 101, and the electrostatic image is converted into a visible image. Here, a voltage is applied to the developing roller 106 by the power supply for bias (not shown).

The toner image developed on the electrophotographic photosensitive member 101 is primarily transferred to an intermediate transfer belt 114. A primary transfer member 115 is in contact with the back surface of the intermediate transfer belt 114, and a voltage is applied to the primary transfer member 115 to primarily transfer a negative toner image from the electrophotographic photosensitive member 101 to the intermediate transfer belt 114. The primary transfer member 115 may have a roller shape or a blade shape.

In the electrophotographic apparatus shown in FIG. 3, a total of four process cartridges 100 containing toners of yellow color, cyan color, magenta color and black color, respectively, are detachably attached on the electrophotographic apparatus main body. The processes of charging, exposure, development and primary transfer are sequentially carried out with a predetermined time interval between the processes, and on the intermediate transfer belt 114, a state is produced in which toner images of four colors are superimposed for drawing full-color images.

The toner images on the intermediate transfer belt 114 are conveyed to a position opposed to a secondary transfer member 116 as the intermediate transfer belt 114 rotates. Here, between the intermediate transfer belt 114 and the secondary transfer member 116, a recording sheet which is a transfer material is conveyed along a conveyance route 117 for the recording sheet at a predetermined time. A secondary transfer bias is applied to the secondary transfer member 116 to transfer the toner images on the intermediate transfer belt 114 to the recording sheet. The recording sheet, to which the toner images have been transferred by the secondary transfer member 116, is conveyed to a fixing unit 118, where the toner images on the recording sheet are melted and fixed on the recording sheet. Thereafter, the recording sheet is discharged to the outside of the electrophotographic apparatus to complete the print operation. Toner images remaining on the electrophotographic photosensitive member 101 without being transferred to the intermediate transfer belt 114 from the electrophotographic photosensitive member 101 are scraped off with a cleaning blade 112 and stored in a waste toner storing container 119.

According to one aspect of the present disclosure, a developing roller can be obtained which enables the image density of electrophotographic images to be kept uniform even when the developing roller is used in an environment at a high temperature and a high humidity for a long period of time. According to another aspect of the present disclosure, a process cartridge and an electrophotographic image forming apparatus can be obtained which are capable of forming high-quality electrophotographic images with stability.

EXAMPLES

The developing roller according to one aspect of the present disclosure will be described in detail by way of Examples and Comparative Examples, and the present disclosure is not limited by the configurations embodied in Examples.

<Acrylate Compound Used for Forming Electrical Insulating Section>

First, the following acrylate compounds A-1 to A-5 were prepared.

(Acrylate Compound A-1)

A urethane acrylate compound "CN9039" (trade name) (manufactured by Sartomer) was used as acrylate compound A-1. The "CN9039" is a compound having a structure of the structural formula (6).

Structural formula (6)

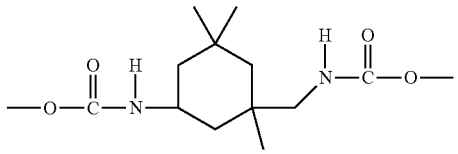

(Acrylate Compound A-2)

A urethane acrylate compound "CN9013" (trade name) (manufactured by Sartomer) was used as acrylate compound A-2. The "CN9013" is a compound having a structure of the structural formula (7).

Structural formula (7)

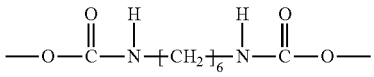

(Acrylate Compound A-3)

In a nitrogen atmosphere, 115 parts by mass of pentaerythritol tetraacrylate (manufactured by Tokyo Chemical Industry Co., Ltd.) was gradually added dropwise to 100 parts by mass of 1,3-bis(isocyanatomethyl)cyclohexane (trade name: TAKENATE 600) (manufactured by Mitsui Chemical, Incorporated) in a reaction vessel while the inside temperature of the reaction vessel was maintained at 65° C. After the dropwise addition, the resulting mixture was reacted at a temperature of 65° C. for 1.5 hours, and the resulting reaction mixture was cooled to room temperature to give urethane acrylate compound A-3. The urethane acrylate compound A-3 is a compound having a structure of the structural formula (8).

Structural formula (8)

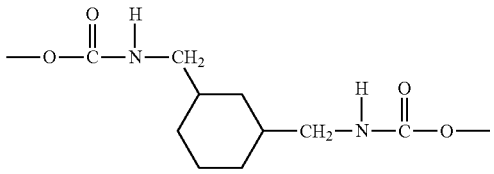

(Acrylate Compound A-4)

In a nitrogen atmosphere, 150 parts by mass of pentaerythritol tetraacrylate (manufactured by Tokyo Chemical Industry Co., Ltd.) was gradually added dropwise to 100 parts by mass of dicyclohexane-4,4'-diisocyanate (manufactured by Tokyo Chemical Industry Co., Ltd.) in a reaction vessel while the inside temperature of the reaction vessel was maintained at 65° C. After the dropwise addition, the resulting mixture was reacted at a temperature of 65° C. for 1.5 hours, and the resulting reaction mixture was cooled to room temperature to give urethane acrylate compound A-4. The urethane acrylate compound A-4 is a compound having a structure of the structural formula (9).

Structural formula (9)

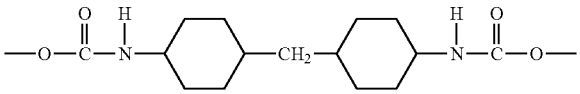

(Acrylate Compound A-5)

In a nitrogen atmosphere, 120 parts by mass of pentaerythritol tetraacrylate (manufactured by Tokyo Chemical Industry Co., Ltd.) was gradually added dropwise to 100 parts by mass of m-xylene diisocyanate (manufactured by Tokyo Chemical Industry Co., Ltd.) in a reaction vessel while the inside temperature of the reaction vessel was maintained at 65° C. After the dropwise addition, the resulting mixture was reacted at a temperature of 65° C. for 1.5 hours, and the resulting reaction mixture was cooled to room temperature to give urethane acrylate compound A-5. The urethane acrylate compound A-5 is a compound having a structure of the structural formula (10).

Structural formula (10)

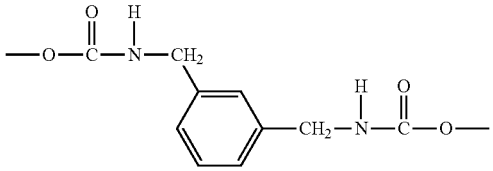

Example 1

(Formation of First Electro-Conductive Layer)

A core metal made of stainless steel (SUS 304) and having a diameter of 6 mm was coated with a primer (trade name "DY39-012") (manufactured by Dow Corning Toray Company Ltd.) to a thickness of 10 μm, placed in a hot-air vulcanization furnace at 150° C. for 15 minutes, and fired to prepare an electro-conductive mandrel. The mandrel was placed in a mold, and an addition silicone rubber composition obtained by mixing the materials shown in Table 1 below was injected into a cavity formed in the mold.

[Table 1]

TABLE 1

| Material for addition silicone rubber composition | parts by mass |
|---|---|
| Liquid silicone rubber material (trade name "SE6905A/B")(manufactured by Dow Corning Toray Company Ltd.) | 100 |

TABLE 1-continued

| Material for addition silicone rubber composition | parts by mass |
|---|---|
| Carbon black (trade name "DENKA BLACK-Powder Type") (manufactured by Denka Company Limited) | 5 |

Subsequently, the addition silicone rubber composition was vulcanized at a temperature of 130° C. for 5 minutes by heating the mold, thereby cured, and demolded. Thereafter, the addition silicone rubber composition was heated at a temperature of 180° C. for 1 hour to complete curing reaction of the silicone rubber layer, thereby producing an electro-conductive roller 1 having a 3 mm-thick first electro-conductive layer on the outer periphery of the mandrel.

(Formation of Second Electro-Conductive Layer)

Next, the materials shown in Table 2 below were mixed, methyl ethyl ketone was added in such a manner that the total solid content ratio was 30 mass %, and the resulting mixture was then mixed by a sand mill. The resulting mixture was adjusted to a viscosity of 10 to 12 cps (mPa·s) with methyl ethyl ketone to prepare a coating solution.

[Table 2]

TABLE 2

| Material | parts by mass |
|---|---|
| Polytetramethylene ether glycol (trade name: PTMG2000) (manufactured by Mitsubishi Chemical Corporation) | 100 |
| Polymeric MDI (trade name: MILLIONATE MR-200) (manufactured by TOSOH CORPORATION) | 20 |
| Carbon black (trade name: MA100) (manufactured by Mitsubishi Chemical Corporation) | 30 |
| Urethane resin fine particle (trade name: ART PEARL C-400) (manufactured by Negami Chemical Industrial Co., Ltd.) | 20 |
| Polyether-modified silicone oil (trade name: TSF4445) (manufactured by Momentive Performance Materials LLC) | 1 |

The electro-conductive roller 1 was coated with the coating solution to a film thickness of 10 μm by a dipping method. In the dipping method, the electro-conductive roller 1 was immersed in the coating solution while the upper end portion of the mandrel was held in such a manner that the longitudinal direction of the electro-conductive roller 1 coincided with the vertical direction. The resulting coated product was dried at room temperature (23° C.) for 30 minutes, and then subjected to curing reaction in an oven at a temperature of 150° C. for 2 hours to produce an electro-conductive roller 2 having a second electro-conductive layer on the outer peripheral surface of the first electro-conductive layer.

(Preparation of Electrical Insulating Section Forming Liquid)

The materials shown in Table 3 below were mixed to prepare an electrical insulating section forming liquid for forming a first region.

[Table 3]

TABLE 3

| Material | parts by mass |
|---|---|
| Urethane acrylate compound A-1 (Trade name: CN9039) (manufactured by Sartomer) | 100 |
| Photopolymerization initiator 1-hydroxycyclohexyl phenyl ketone (trade name: Omnirad 184) (manufactured by IGM Resins) | 5 |

(Formation of Electrical Insulating Section)

The electrical insulating section forming liquid was discharged into the electro-conductive roller 2 with a piezoelectric inkjet head while the mandrel was rotated at a rotation speed of 500 rpm. The amount of a droplet from the inkjet head was adjusted to 15 pl.

The discharge was performed in such a manner that dots of the liquid deposited on the electro-conductive roller 2 had a pitch (center-to-center distance) of 100 μm in each of the circumferential direction and the mandrel direction. Subsequently, using a metal halide lamp, an ultraviolet ray having a wavelength of 254 nm was applied to the dots of the liquid for 5 minutes so as to attain an integrated light amount of 1500 mJ/cm$^2$, whereby a first region serving as an electrical insulating section was formed on the outer surface of the second electro-conductive layer. In this way, a developing roller 1 provided with first region was produced.

(Confirmation of First Region and Second Region)

The presence of the first region and the second region on the outer surface of the developing roller 1 was confirmed in the following manner.

<Observation of Outer Surface of Developing Roller>

The outer surface of the developing roller 1 was observed at a magnification of 1000 times with an optical microscope (trade name: VHX5000 (product name)) (manufactured by KEYENCE CORPORATION). The result showed that the roller surface had a dot-shaped first region formed by inkjet coating, and a second region with an electro-conductive layer exposed to the surface. The area ratios of the first region and the second region to the outer surface area of the developing roller were 30% and 70%, respectively.

<Measurement of Resistance of First Region>

A sample including a first region was cut out from the developing roller 1 at any position thereof, and a thin piece sample having a two-dimensional size of 50 μm square and a thickness t of 100 nm was prepared with a microtome. Next, the thin piece sample was placed on a metal flat plate, and a metal terminal with a pressing surface area S of 100 μm$^2$ was pressed against the thin piece sample from above. In this state, a voltage of 1 V was applied between the metal terminal and the metal flat plate with Electrometer 6517B (trade name) (manufactured by KEITHLEY Instruments) to determine a resistance R. From the resistance R, a volume resistivity pv (Ω·cm) was calculated based on the following expression.

$$pv=R\times S/t$$

The obtained volume resistivity was $1.8\times10^{14}$ Ω·cm.

<Measurement of Resistance of Second Region>

A sample including a second region was cut out from the developing roller 1 at any position thereof, and a thin piece sample having a two-dimensional size of 50 μm square and a thickness t of 100 nm was prepared with a microtome. Next, the thin piece sample was placed on a metal flat plate, and a metal terminal with a pressing surface area S of 100

$\mu m^2$ was pressed against the thin piece sample from above. In this state, a voltage of 1 V was applied between the metal terminal and the metal flat plate with Electrometer 6517B (trade name) (manufactured by KEITHLEY Instruments) to determine a resistance R. From the resistance R, a volume resistivity pv (Ω·cm) was calculated based on the following expression.

$$pv=R\times S/t$$

The obtained volume resistivity was $6.7\times10^6$ Ω·cm.

<NMR Measurement of First Region>

For confirming the chemical structure of the first region, the first region at any position on the developing roller was taken with a micromanipulator (trade name: Axis Pro) (manufactured by Micro Support Co., Ltd.). The sample taken was crushed under liquid nitrogen cooling for 10 minutes with a freeze crusher "JFC-300" (trade name) (manufactured by Japan Analytical Industry Co., Ltd.) to give a fine-powdery sample. The sample was subjected to solid $^1$H-NMR analysis, and from the obtained spectrum, a chemical structure was identified to determine that a structure of the following structural formula (5) and a structure of the following structural formula (6) were present.

Structural formula (5)

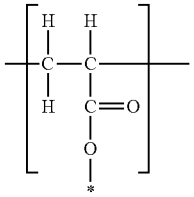

Structural formula (6)

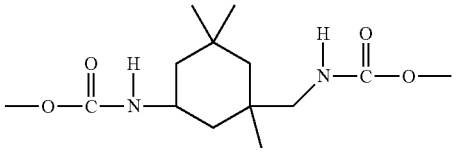

(Measurement of Vickers Hardness and Fracture Toughness Value)

The Vickers hardness and the fracture toughness value of the first region serving as an electrical insulating section were measured as follows based on the measurement procedure of the IF method described in the Japanese Industrial Standard (JIS) R1607: 2015 (Testing Methods for Fracture Toughness of Fine Ceramics at Room Temperature). A microhardness tester (trade name: FISCHERSCOPE PICODENTOR HM500) (manufactured by Fischer Instruments K.K.) was used as a measurement apparatus, and a Vickers indenter was used as a measurement indenter. The developing roller was horizontally placed, and a surface of the developing roller, which was covered with the electrical insulating section, was observed with a microscope. The position was adjusted so that the indenter contacted the electrical insulating section at any position, and the indenter was made to contact the electrical insulating section with a test load of 0.1 mN and a test load holding time of 15 seconds. Thereafter, the contact surface of the electrical insulating section was observed with an optical microscope, the lengths of two diagonal lines of the indenter trace were measured, and an average of the lengths was calculated. The lengths of cracks extending along the extended lines of two diagonal lines of the indenter trace were measured, and an average of the lengths was calculated. From the obtained average of the lengths of the diagonal lines of the indenter trace, and the test load, the Vickers hardness was calculated based on the following expression.

$$\text{Vickers hardness}=0.1891\times F/d^2$$

F: Test load [N];

d: Average of lengths of diagonal lines of indenter trace [mm].

From the obtained average of the lengths of the diagonal lines of the indenter trace, and the test load, the fracture toughness value was calculated based on the following expression.

$$\text{Fracture toughness value } [\text{Pa}\cdot\text{m}^{0.5}]=0.026\times E^{0.5}\times F^{0.5}\times a/C^{1.5}$$

E: elastic modulus of electrical insulating section [Pa]

F: Test load [N];

a: Average of lengths of diagonal lines of indenter trace [m];

C: Average of lengths of cracks [m].

(Measurement of Taber Abrasion Loss)

The electrical insulating section forming liquid was applied to a 0.2 mm-thick aluminum sheet with a bar coater to prepare a 42 μm-thick sheet. For the sheet, a Taber abrasion loss (mg) was measured under the conditions of a load of 9.8 N, a rotation speed of 60 rpm and test frequency of 2000 times with a Taber abrasion tester (trade name: Rotary Abrasion Tester) (manufactured by Toyo Seiki Seisaku-sho, Ltd.). Table 6 shows the results.

(Evaluation of Image)

The prepared developing roller was left standing in environment I (40° C. and 95% RH) for 12 hours. Subsequently, the developing roller was left standing in environment II (15° C. and 10% RH) for 12 hours. The process in which the developing roller is left standing in environment I for 12 hours and then in environment II for 12 hours was set as one cycle, and the cycle was repeated five times. Using the developing roller, formation of electrophotographic images was evaluated in the following manner.

For the purpose of reducing the torque of a developer supply roller, a gear of a toner supply roller was removed from a process cartridge (trade name: HP 410X High Yield Magenta Original LaserJet Toner cartridge (CF413X)) (manufactured by HP Company). Removal of the gear causes the toner supply roller to have a lower torque as compared to the torque of the developing roller, so that the amount of a toner scraped off from the developing roller decreases. Next, the prepared developing roller 1 was incorporated in the process cartridge, and the process cartridge was packed in a laser beam printer (trade name: Color LaserJet Pro M452dw) (manufactured by HP Company) (output machine for sheet of size 4 in A series format in ISO 216). The laser beam printer was left standing in an environment at a temperature of 30° C. and a relative humidity of 80% for 24 hours.

Next, in the same environment, a sheet of a full-page-solid image was output, and the following process was then repeated 30 times. 1000 sheets of images with a coverage ratio of 0.5% were output, and a sheet of full-page-solid image was output. Thereafter, the image densities of the 31 sheets of full-page-solid images obtained were measured with a spectral densitometer: X-Rite 504 (trade name) (SDG Co., Ltd.). The image density was an average of values obtained by performing measurement at randomly selected 15 positions for each sheet of the full-page-solid image. Image densities with respect to the number of output sheets were compared, and evaluation was performed based on the evaluation criteria shown in Table 4. Table 6 shows the results. Hereinafter, the image density of the solid image output first is referred to as an "initial image density", and the image density of the solid image output in the Xth process is referred to as an "Xth image density".

[Table 4]

TABLE 4

| Evaluation grade | Evaluation criteria |
|---|---|
| A | The difference between the initial image density and the 25th image density is less than 0.1 and the difference between the initial image density and the 31st image density is less than 0.1. |
| B | The difference between the initial image density and the 25th image density is less than 0.1 and the difference between the initial image density and the 31st image density is 0.1 or more and less than 0.3. |
| C | The difference between the initial image density and the 25th image density is less than 0.1 and the difference between the initial image density and the 31st image density is 0.3 or more. |
| D | The difference between the initial image density and the 25th image density is 0.1 or more and less than 0.3. |
| E | The difference between the initial image density and the 25th image density is 0.3 or more. |

Examples 2 to 5 and Comparative Examples 1 to 3

Except that the materials to be used for the electrical insulating section forming liquid were changed to those in Table 5 below, the same procedure as in Example 1 was carried out to prepare developing rollers 2 to 8. The obtained developing rollers 2 to 8 were evaluated in the same manner as in Example 1. Table 6 shows the results.

TABLE 5

| | | Example 1 | Example 2 | Example 3 | Example 4 | Example 5 | Comparative Example 1 | Comparative Example 2 | Comparative Example 3 |
|---|---|---|---|---|---|---|---|---|---|
| (Meth)acrylate compound | Urethane compound A-1 trade name: CN9039 | 100 parts by mass | — | — | — | — | — | — | — |
| | Urethane compound A-2 trade name: CN9013 | — | 100 parts by mass | — | — | — | — | — | — |
| | Urethane compound A-3 | — | — | 100 parts by mass | — | — | — | — | — |
| | Urethane compound A-4 | — | — | — | 100 parts by mass | — | — | — | — |
| | Urethane compound A-5 | — | — | — | — | 100 parts by mass | — | — | — |
| | Polyester acrylate compound trade name: CN294 | — | — | — | — | — | — | 100 parts by mass | — |
| | Epoxy acrylate compound trade name CN111 | — | — | — | — | — | — | — | 100 parts by mass |
| | Methyl methacrylate compound trade name: Acryl Ester M | — | — | — | — | — | 100 parts by mass | — | — |
| Photopolymerization initiator | 1-hydroxycyclohexyl phenyl ketone trade name: Omnirad184 | 5 parts by mass | 5 parts by mass | 5 parts by mass | 5 parts by mass | 5 parts by mass | 5 parts by mass | 5 parts by mass | 5 parts by mass |
| Chemical structure | Linking group R | Urethane bond present | Urethane bond present | Urethane bond present | Urethane bond present | Urethane bond present | No urethane bond | No urethane bond | No urethane bond |
| | Structural formula (3) | Structural formula (6) | Structural formula (7) | Structural formula (8) | Structural formula (9) | Structural formula (10) | — | — | — |

Structural formula (6):

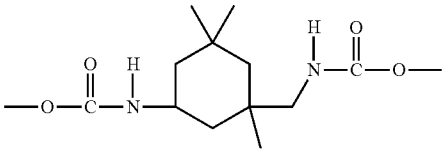

Structural formula (7):

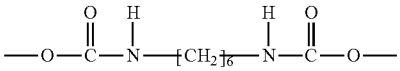

Structural formula (8):

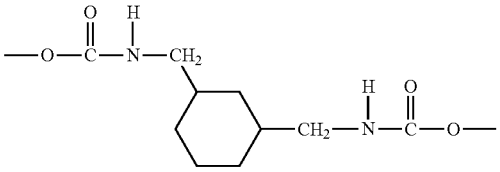

TABLE 5-continued

| | Example 1 | Example 2 | Example 3 | Example 4 | Example 5 | Comparative Example 1 | Comparative Example 2 | Comparative Example 3 |
|---|---|---|---|---|---|---|---|---|

Structural formula (9):

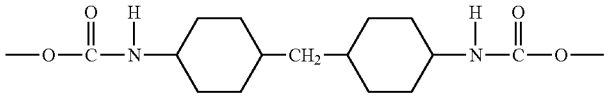

Structural formula (10):

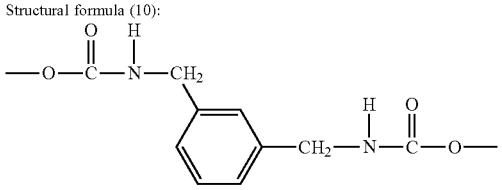

[Table 6]

TABLE 6

| | Example 1 | Example 2 | Example 3 | Example 4 | Example 5 | Comparative Example 1 | Comparative Example 2 | Comparative Example 3 |
|---|---|---|---|---|---|---|---|---|
| Vickers hardness | 20.8 | 21.2 | 19.2 | 15.4 | 24.6 | 2.8 | 23.4 | 23.2 |
| Fracture toughness value [Pa · $m^{0.5}$] | 1208 | 1391 | 1330 | 995 | 892 | 902 | 688 | 621 |
| Taber abrasion loss [mg] | 5.1 | 5.3 | 5.4 | 7.9 | 4.6 | 97.4 | 4.5 | 4.3 |
| Evaluation grade of image | A | A | A | B | B | E | D | D |

As shown in Table 6, it has become apparent that use of the developing rollers according to Examples 1 to 5 enables the image density of the electrophotographic image to be kept uniform even when the developing roller is used in an environment at a high temperature and a high humidity for a long period of time. In particular, Examples 1 to 3 in which a urethane acrylate having a structure of the structural formula (4) was used for the electrical insulating section enabled the image density to be kept uniform at a higher level. On the other hand, Comparative Example 1 in which the Vickers hardness was less than 10.0 and Comparative Examples 2 and 3 in which the fracture toughness value was less than 800 Pa·$m^{0.5}$ showed the result of a significant change in image density.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-092209, filed May 15, 2019, which is hereby incorporated by reference herein in its entirety.

What is claimed is:

1. A developing roller comprising:

an electro-conductive mandrel; and an electro-conductive layer on the mandrel, the developing roller having an outer surface constituted by at least a first region which is electrically insulating, and a second region, the second region having higher electro-conductivity than that of the first region, the first region being arranged adjacent to the second region, the first region being disposed on an outer surface of the electro-conductive layer, the first region having a Vickers hardness of 10.0 or more as measured at an outer surface thereof, and the first region having a fracture toughness value of 800 Pa·$m^{0.5}$ or more as measured at the outer surface thereof by an indentation fracture method.

2. The developing roller according to claim 1, wherein the first region comprises a resin having a structure of the following formula (1):

$$[A]_n\text{-}R \qquad \text{formula (1)}$$

wherein A represents a structure of the following formula (2), n represents an integer of 2 or more, and R represents a linking group linking n As;

Formula (2)

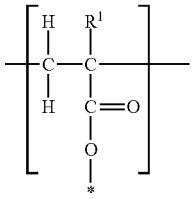

wherein $R^1$ represents a hydrogen atom or a methyl group, and the symbol * represents a binding site with the linking group R.

3. The developing roller according to claim 2, wherein the linking group R has a urethane bond.

4. The developing roller according to claim 3, wherein the linking group R has a structure of the following formula (3):

formula (3)

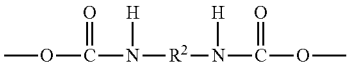

wherein $R^2$ is an alkylene group having 6 or more carbon atoms, and the alkylene group optionally has a cyclic structure.

5. The developing roller according to claim 4, wherein $R^2$ in the formula (3) has a structure of the following formula (4):

formula (4)

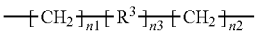

wherein n1 and n2 are each independently an integer of 0 or more, n3 is 0 or 1, n1+n2 is 6 or more and 10 or less when n3 is 0, n1+n2 is 0 or more and 4 or less when n3 is 1, and $R^3$ is a cyclic alkylene group optionally having a substituent.

6. A process cartridge detachably attachable on a main body of an electrophotographic image forming apparatus, the process cartridge comprising at least a developing unit, the developing unit comprising a developing roller, the developing roller comprising an electro-conductive mandrel and an electro-conductive layer on the mandrel, the developing roller having an outer surface constituted by at least a first region which is electrically insulating, and a second region, the second region having higher electro-conductivity than that of the first region, the first region being arranged adjacent to the second region, the first region being disposed on an outer surface of the electro-conductive layer, the first region having a Vickers hardness of 10.0 or more as measured at an outer surface thereof, and the first region having a fracture toughness value of 800 $Pa \cdot m^{0.5}$ or more as measured at the outer surface thereof by an indentation fracture method.

7. An electrophotographic image forming apparatus comprising a developing unit, the developing unit comprising a developing roller, the developing roller comprising an electro-conductive mandrel and an electro-conductive layer on the mandrel, the developing roller having an outer surface constituted by at least a first region which is electrically insulating, and a second region, the second region having higher electro-conductivity than that of the first region, the first region being arranged adjacent to the second region, the first region being disposed on an outer surface of the electro-conductive layer, the first region having a Vickers hardness of 10.0 or more as measured at an outer surface thereof, and the first region having a fracture toughness value of 800 $Pa \cdot m^{0.5}$ or more as measured at the outer surface thereof by an indentation fracture method.

* * * * *